US012065287B1

(12) United States Patent
Hu et al.

(10) Patent No.: US 12,065,287 B1
(45) Date of Patent: Aug. 20, 2024

(54) THREADLESS STOPPER COVER FOR CONTAINERS

(71) Applicant: Zhejiang Coolests Technology Co., Ltd., Jinhua (CN)

(72) Inventors: Weizhen Hu, Jinhua (CN); Changgen Ying, Jinhua (CN)

(73) Assignee: Zhejiang Coolests Technology Co., Lid., Jinhua (CN)

( * ) Notice: Subject to any disclaimer, the term of this patent is extended or adjusted under 35 U.S.C. 154(b) by 0 days.

(21) Appl. No.: 18/586,419

(22) Filed: Feb. 23, 2024

Related U.S. Application Data

(63) Continuation of application No. PCT/CN2023/131151, filed on Nov. 13, 2023.

(30) Foreign Application Priority Data

Oct. 26, 2023 (CN) ..... 202311397266.X
Oct. 26, 2023 (CN) ..... 202322879473.0

(51) Int. Cl.
*B65D 39/12* (2006.01)
*B65D 39/16* (2006.01)

(52) U.S. Cl.
CPC ..... *B65D 39/12* (2013.01); *B65D 39/16* (2013.01)

(58) Field of Classification Search
CPC ..... B65D 39/12; B65D 39/14; B65D 39/16; B65D 45/322; B67D 1/0431; F16L 33/225; B67B 7/06
USPC ..... 220/200, 233–238; 215/358–361
See application file for complete search history.

(56) References Cited

U.S. PATENT DOCUMENTS 3,726,445 A * 4/1973 Ostrowsky ..... B65D 83/206 222/402.11
3,750,822 A * 8/1973 Dubach ..... B65D 15/14 215/361
6,279,773 B1 * 8/2001 Kiyota ..... B65D 77/283 220/709
9,181,000 B2 * 11/2015 Yoshida ..... B65D 41/16
9,221,585 B1 * 12/2015 Wang ..... B65D 41/02
2004/0067091 A1 * 4/2004 Tsutsumi ..... B65D 55/12 215/280
2004/0232174 A1 * 11/2004 Hayakawa ..... B65D 50/045 222/556
2008/0272085 A1 * 11/2008 Laporta ..... B65D 39/0064 215/358

(Continued)

FOREIGN PATENT DOCUMENTS

CN 202944659 U * 5/2013
CN 105502249 A * 4/2016 ..... B67B 7/06

(Continued)

*Primary Examiner* — Chun Hoi Cheung
*Assistant Examiner* — Brijesh V. Patel
(74) *Attorney, Agent, or Firm* — Mei & Mark LLP; Manni Li

(57) ABSTRACT

A threadless container stopper cover comprises an outer cover body, an inner cover body and a sealing sleeve sleeved on an outer wall of the inner cover body, where the outer cover body and the inner cover body are fixedly connected, and a first gap for accommodating a container mouth portion is formed between the sealing sleeve and the outer cover body. Limiting members are arranged inside the linkage body, and the outer cover body is provided with control members capable of locking or releasing the limiting members.

7 Claims, 5 Drawing Sheets

(56) References Cited

U.S. PATENT DOCUMENTS

| | | | | |
|---|---|---|---|---|
| 2012/0175336 | A1* | 7/2012 | Miller | B65D 3/04<br>215/216 |
| 2018/0050846 | A1 | 2/2018 | Shao | |
| 2023/0286704 | A1 | 9/2023 | Zamora et al. | |

FOREIGN PATENT DOCUMENTS

| | | | |
|---|---|---|---|
| CN | 215045212 | U | 12/2021 |
| CN | 114524181 | A | 5/2022 |
| CN | 217893734 | U | 11/2022 |
| JP | 3226157 | U | 5/2020 |

* cited by examiner

THREADLESS STOPPER COVER FOR CONTAINERS

CROSS-REFERENCE TO RELATED APPLICATIONS

The subject application is a continuation of PCT/CN2023/131151 filed on Nov. 13, 2023, which in turn claims priority on Chinese Patent Application Nos. CN202322879473.0 and CN202311397266.X, both filed on Oct. 26, 2023 in China. The contents and subject matters of the PCT international stage application and Chinese priority applications are incorporated herein by reference.

TECHNICAL FIELD

The present invention relates to container structures, and particularly, relates to a threadless stopper cover for containers.

BACKGROUND

Threaded cover bodies or solid rubber stoppers are generally used for sealing existing containers. However, in the process of using a threaded cover body, tedious rotation is required to open and close; and other auxiliary tools are usually needed to open a solid rubber stopper, which is relatively time-consuming, while a rubber stopper that is easily opened usually has poor sealing properties and limited service life.

Therefore, existing container cover bodies with good sealing properties cannot be opened and closed quickly; and other container cover bodies that may be opened or closed quickly have poor sealing properties and poor thermal insulation and leakage prevention effects.

In order to solve the above problems, Chinese invention patent CN104803085B discloses a container stopper that can be rapidly opened and closed, including a columnar stopper body, an annular stopper body and an elastic sealing sleeve. The columnar stopper body includes a stopper rod, a bottom portion of the stopper rod is provided with a base that can be inserted into or pulled out of the container, and the shape and size of the base correspond to the shape and size of a straight section of the container mouth or a minimum cross section of the container.

The annular stopper body is arranged above the base, a foldable and deformable elastic sealing sleeve is arranged between the annular stopper body and the base, and the annular stopper body and the base, under the action of an external force, can both move mutually along an axial direction of the container in the container to press the elastic sealing sleeve, such that the elastic sealing sleeve is radially expanded outwardly to form a sealing sleeve between an inner wall of the container and an outer contour of the base, an outer contour size of the sealing sleeve is larger than an inner surface size of the straight section of the container or the inner surface size of the container at the minimum cross section, and the sealing sleeve and the base together form a sealing layer which realizes the rapid closing of the container. At the time of opening, when the squeezing external force on the elastic sealing sleeve is released, the elastic sealing sleeve, under the action of an elastic force, drives the annular stopper body to move upwards relative to the base, and the elastic sealing sleeve restores its straightened state to realize rapid opening of the container.

Although quick opening or closing of the container stopper of the above technical solution can be realized, there are some insurmountable defects. When the container mouth needs to be closed through the container stopper, space between the columnar stopper body and the annular stopper body causes the elastic sealing sleeve to expand toward an inner wall direction of the container or in an opposite direction after being squeezed, so that the effect of sealing the container mouth cannot be achieved when squeezing every time; and when it is necessary to quickly open the container stopper, the above technical solution relies on elasticity of the elastic sealing sleeve itself, but in reality, the elasticity of the elastic sealing sleeve is not enough to make the annular stopper body rise, and an upward external force is required to achieve.

SUMMARY OF INVENTION

An objective of the present invention is to provide a threadless stopper cover for containers, mainly to solve the problems in the current technology that an elastic sealing sleeve cannot expand in a directional manner, and the container stopper cannot be opened freely only by relying on elasticity of the elastic sealing sleeve.

In order to achieve the above objective, the present invention provides a technical solution as follows:

a threadless container stopper cover, comprising an outer cover body, an inner cover body and a sealing sleeve sleeved on an outer wall of the inner cover body, where the outer cover body and the inner cover body are fixedly connected, and a first gap for accommodating a container mouth portion is formed between the sealing sleeve and the outer cover body; the inner cover body is provided with a driving assembly capable of moving up and down and squeezing the sealing sleeve for radial expansion; the inner cover body comprises a cylinder body and a first flange protruding outward at the top of the cylinder body, wherein the first flange is fixedly connected to an inner wall of the outer cover body, and the sealing sleeve is sleeved on an outer wall of the cylinder body;

the driving assembly comprises a driving plate, a linkage assembly and a base, wherein the driving plate is provided with sliding rods, and sliding rod holes for the sliding rods to pass through are formed on the first flange; the linkage assembly comprises a linkage body that can be inserted into the cylinder body of the inner cover body and a second flange protruding outward at the top of the linkage body; the driving plate is arranged on a lower surface of the first flange, and the sliding rod penetrates through the sliding rod hole and is fixedly connected with the second flange; the base is arranged at the bottom of the linkage body, and the bottom of the sealing sleeve is in contact with the base; and limiting members are arranged inside the linkage body, and the outer cover body is provided with control members capable of locking or releasing the limiting members.

In the present invention, two limiting members may be arranged inside the linkage body, each limiting member includes two oppositely arranged limiting rods, protruding limiting blocks are arranged at relative positions at upper ends of the two limiting rods, and a second gap is formed between the two limiting blocks; and two mounting holes are symmetrically formed on an outer wall of the outer cover body, the control members are arranged in the mounting holes, and the control member includes buttons and a first elastic reset member, wherein the buttons include a pressing portion, a release portion extending toward the inside of the outer cover body and having a width smaller than that of the second gap, and a locking portion having a width larger than that of the second gap that are fixedly connected from outside to inside.

In the present invention, a fixing member may be arranged inside the inner cover body, and a second elastic reset member is arranged between the fixing member and the bottom of the linkage body.

In the present invention, a clamping portion may be arranged on the base, an upward recessed portion is formed at the bottom of the linkage body, and a clamping interface for receiving the clamping portion is arranged on an inner wall of the recessed portion.

In the present invention, through holes are formed at the same bottom positions of the base and the linkage body, and the two through holes are connected to form an exhaust hole. An exhaust rod is further arranged, and the exhaust rod includes a rod body and a rod cap with a radius larger than the radius of the rod body and arranged at an upper end thereof, where an upper end of the rod cap abuts against the fixing member, a lower end of the rod body is arranged in the exhaust hole, a third elastic reset member is sleeved outside the rod body, an upper end of the third elastic reset member abuts against a lower end of the rod cap, and a lower end of the third elastic reset member abuts against the bottom of the linkage body.

In the present invention, an inwardly protruding bottom flange may be arranged at the bottom of the sealing sleeve, and the bottom flange is in contact with the base.

In the present invention, the driving plate may be provided with at least two sliding rods, and the sliding rod holes consistent with the sliding rods in quantity are formed on the first flange; a hook is arranged at the top of each sliding rod, and the second flange is provided with bayonets (consistent with the sliding rods in quantity) for fixing the hooks.

The technical solution provided by the present invention has the following advantages.

First, when covering the container mouth with the container stopper cover, the container mouth portion is pushed against the driving plate, the driving plate moves upward to drive the linkage body and the base to move upward, and the base drives the bottom of the sealing sleeve to move upward to squeeze the sealing sleeve, so that the sealing sleeve radially expands outward to seal the container mouth, and the container mouth portion is used to drive closing of the stopper cover, which is simple in implementation.

Second, the bottom flange of the sealing sleeve ensures that the sealing sleeve can radially expand outward after being squeezed.

Third, the second elastic reset member between the fixing member and the bottom of the linkage body ensures that when the container stopper cover is opened, the sealing sleeve is fully restored to an initial state, so that the stopper cover can be pulled out smoothly.

In the figures, the reference numbers refer to the following structures: 1—outer cover body; 11—mounting hole; 2—inner cover body; 21—cylinder body; 22—first flange; 23—sliding rod hole; 3—sealing sleeve; 31—bottom flange; 41—driving plate; 411—sliding rod; 412—hook; 42—second flange; 421—bayonet; 43—linkage body; 431—clamping interface; 44—base; 441—clamping portion; 45—limiting rod; 46—limiting block; 47—second gap; 5—control member; 51—pressing portion; 52—first elastic reset member; 53—release portion; 54—locking portion; 61—fixing member; 62—second elasticity elastic reset member; 7—exhaust rod; 71—third elastic reset member; 72—rod body; 73—rod cap; 8—container mouth portion; and 81—first gap.

DETAILED DESCRIPTIONS OF THE EMBODIMENTS

The present invention is further described below with reference to the accompanying drawings. The accompanying drawings are for illustrative description only and may not be construed as a limitation on the present invention.

In order to explain this embodiment more concisely, some parts and components that are well known to those skilled in the art but are not relevant to the main content of the present invention might be omitted in the accompanying drawings or descriptions. In addition, for the convenience of description, some parts and components in the accompanying drawings may be omitted, enlarged or downsized, but this does not represent the size or entire structure of an actual product.

Figure 1:
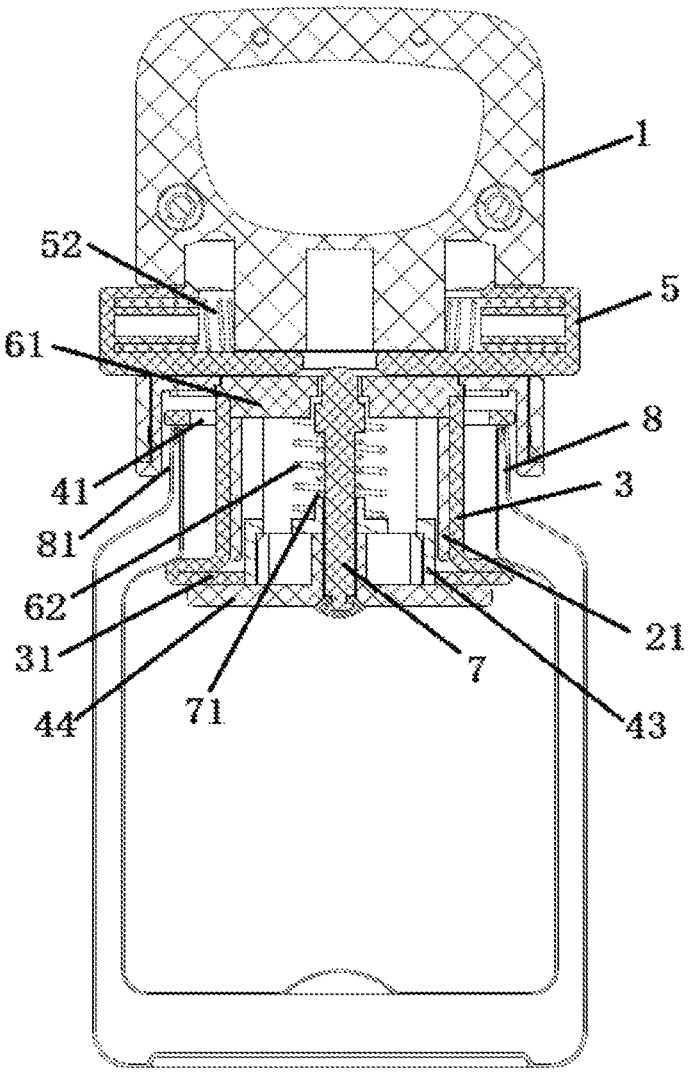
FIG. 1 shows the structure of the sealed container mouth portion of the threadless stopper cover in the present invention.

The present invention discloses a threadless container stopper cover. As shown in FIG. 1, the container stopper cover includes an outer cover body 1, an inner cover body 2 and a sealing sleeve 3 sleeved on an outer wall of the inner cover body 2, where the outer cover body 1 and the inner cover body 2 are fixedly connected, a first gap 81 for accommodating a container mouth portion 8 is formed between the sealing sleeve 3 and the outer cover body 1, and the stopper cover is inserted into the container mouth portion 8 through the first gap 81.

Figure 3:
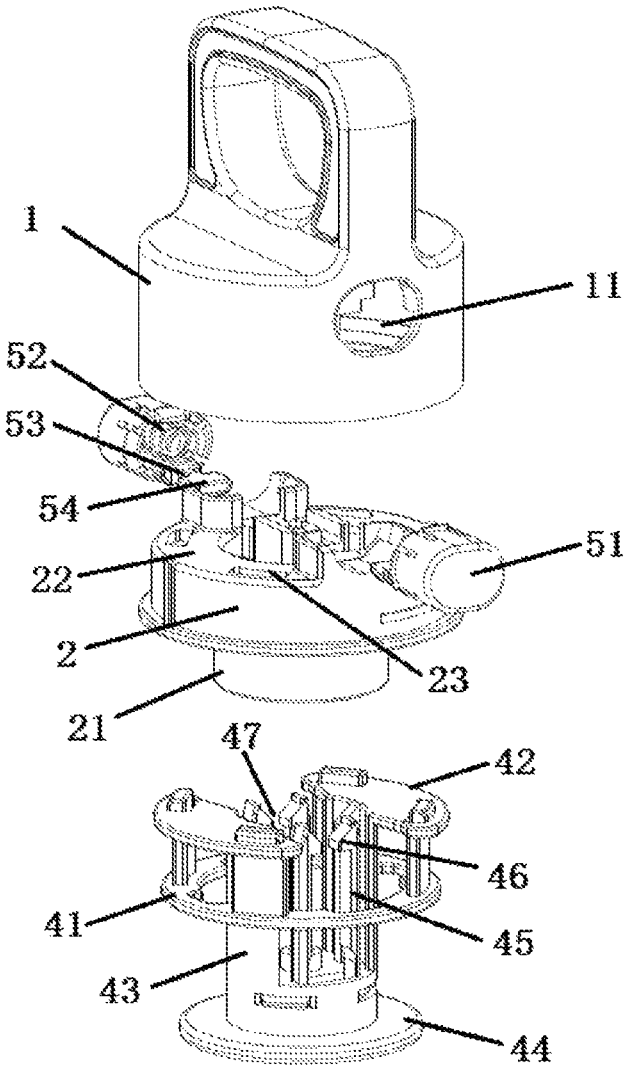
FIG. 3 shows the breakdown structure of the threadless stopper cover of the present invention.
Figure 4:
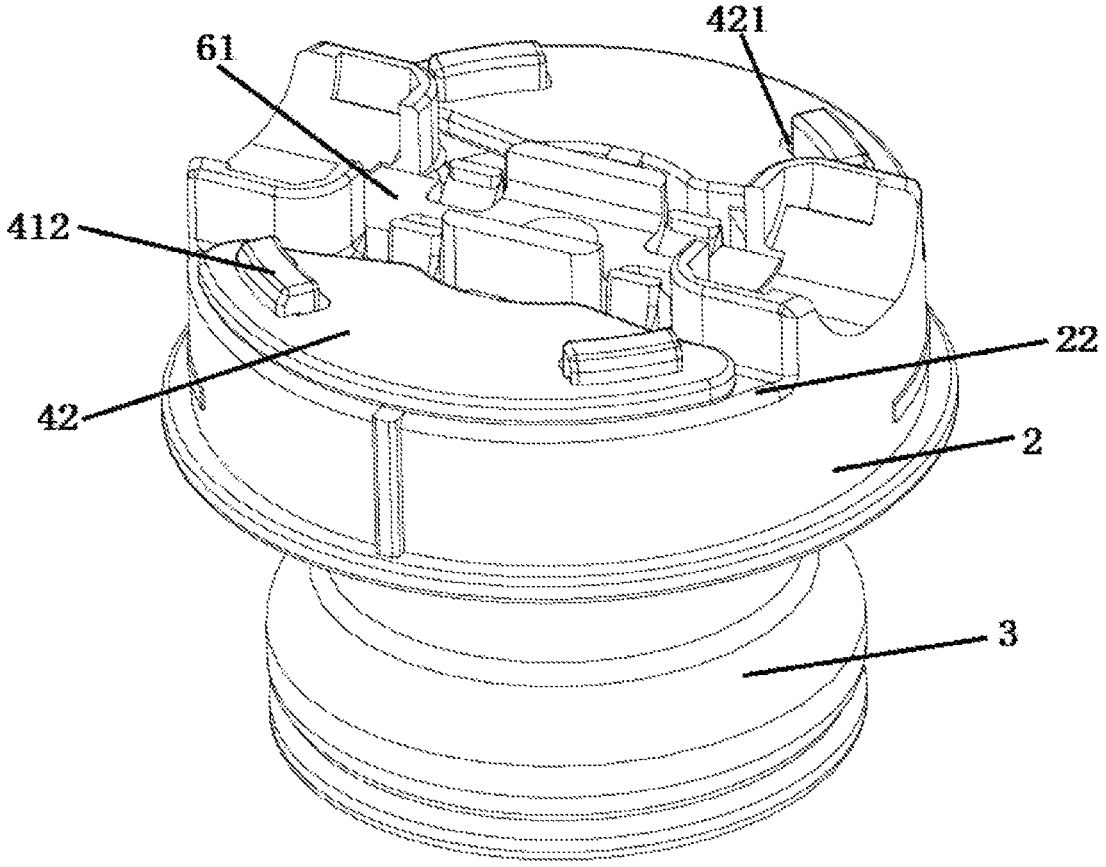
FIG. 4 shows the structure of connecting a driving assembly with an inner cover body and a sealing sleeve in the threadless stopper cover of the present invention.
Figure 5:
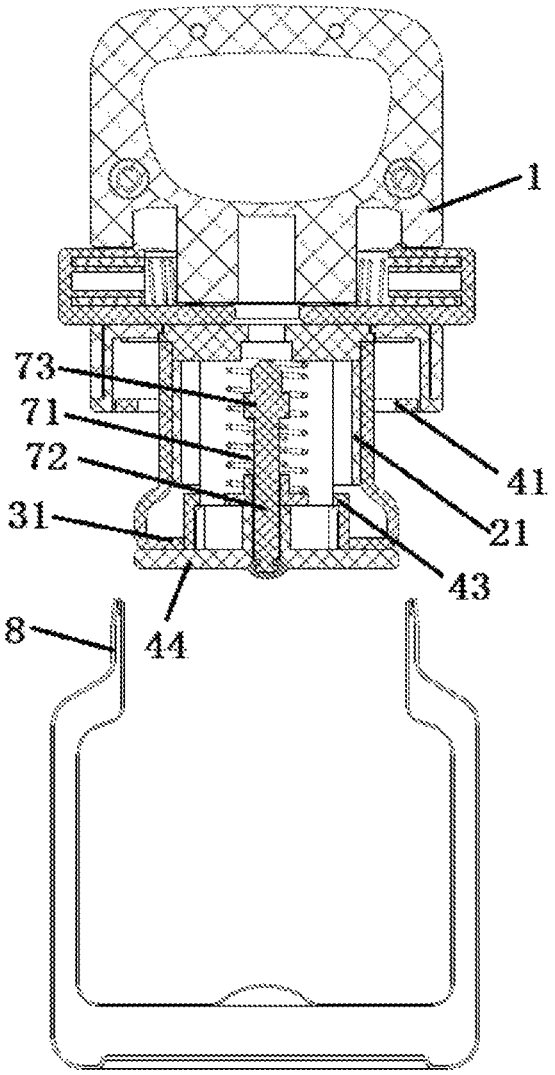
FIG. 5 shows the structure of the threadless stopper cover in the present invention where it is opened from a container mouth portion.

With reference to FIGS. 4 and 5, the inner cover body 2 is provided with a driving assembly capable of moving up and down and squeezing the sealing sleeve 3 for radial expansion; and as shown in FIGS. 3 and 4, the inner cover body 2 includes a cylinder body 21 and a first flange 22 protruding outward at the top of the cylinder body, where the first flange 22 is fixedly connected to an inner wall of the outer cover body 1, and the sealing sleeve 3 is sleeved on an outer wall of the cylinder body 21.

Figure 2:
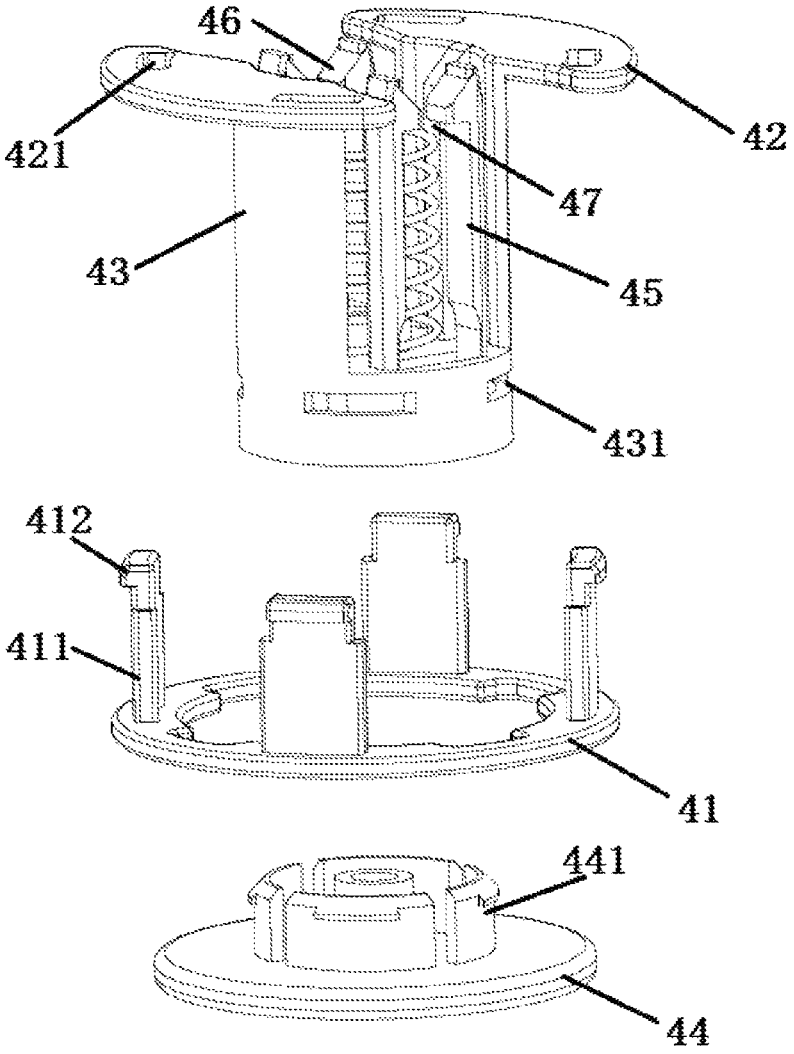
FIG. 2 shows the structure of the driving assembly of the threadless stopper cover in the present invention.

As shown in FIG. 2, the driving assembly includes a driving plate 41, a linkage assembly and a base 44, where the driving plate 41 is provided with sliding rods 411, and sliding rod holes 23 for the sliding rods 411 to pass through are formed on the first flange 22; the linkage assembly includes a linkage body 43 that can be inserted into the cylinder body 21 of the inner cover body and a second flange 42 protruding outward at the top of the linkage body; the sliding rod 411 of the driving plate 41 penetrates through the sliding rod hole 23 from a lower surface of the first flange 2 and is fixedly connected with the second flange 42, so that when the driving plate 41 moves upward, the linkage assembly is driven to move upward, and when the driving plate 41 moves downward, the linkage assembly is driven to move downward.

Preferably, as shown in FIGS. 2 and 3, the driving plate 41 is provided with at least two sliding rods 411, and the sliding rod holes 23 consistent with the sliding rods 411 in quantity are formed on the first flange 22; a hook 412 is arranged at the top of each sliding rod 411, and the second flange 42 is provided with bayonets 421 (consistent with the sliding rods 411 in quantity) for fixing the hooks 412.

The base 44 is arranged at the bottom of the linkage body 43, and the bottom of the sealing sleeve 3 is in contact with the base 44; as shown in FIG. 1, when the driving plate 41 is pushed upward due to insertion of the container mouth portion 8, the linkage assembly is driven to move upward, and the base 44 squeezes the bottom of the sealing sleeve 3, so that the sealing sleeve 3 radially expands outward and squeezes the bottom of the container mouth portion 8 so that the stopper cover cannot be pulled out. Preferably, an inwardly protruding bottom flange 31 is arranged at the bottom of the sealing sleeve 3, and the bottom flange 31 is in contact with the base 44, thus ensuring that the bottom of the sealing sleeve 3 radially expands outward when being squeezed.

As shown in FIG. 2, a clamping portion 441 is arranged on the base 44, an upward recessed portion is formed at the bottom of the linkage body 43, and a clamping interface 431 for receiving the clamping portion 441 is arranged on an inner wall of the recessed portion.

Further, as shown in FIG. 3, a fixing member 61 is arranged inside the inner cover body 2, and a second elastic reset member 62 is arranged between the fixing member 61 and the bottom of the linkage body 43 to ensure that after squeezing of the sealing sleeve 3 is released by the base 44, the sealing sleeve 3 is capable to quickly and fully restore its initial state.

In order to make the stopper cover seal the container well or to pull the stopper cover out of the container, as shown in FIG. 3, limiting members are arranged inside the linkage body 43, and the outer cover body 1 is provided with control members 5 capable of locking or releasing the limiting members.

As shown in FIG. 2, two limiting members are arranged inside the linkage body 43, each limiting member includes two oppositely arranged limiting rods 45, protruding limiting blocks 46 are arranged at relative positions at upper ends of the two limiting rods 45, and a second gap 47 is formed between the two limiting blocks 46.

Correspondingly, as shown in FIG. 3, two mounting holes 11 are symmetrically formed on an outer wall of the outer cover body 1, the control members 5 are arranged in the mounting holes 11, and the control member 5 includes buttons and a first elastic reset member 52, where the buttons include a pressing portion 51, a release portion 53 extending toward the inside of the outer cover body and having a width smaller than that of the second gap 47, and a locking portion 54 having a width larger than that of the second gap 47 that are fixedly connected from outside to inside.

When control member 5 is in an initial state, the locking portion 54 is located above the limiting member. As shown in FIG. 1, when the stopper cover is inserted and the container mouth portion 8 is to be sealed, the container mouth portion 8 moves upward against the driving plate 41, and the two oppositely arranged limiting blocks 46 move upward, are squeezed apart by the locking portion 54 at the second gap 47, and rest against an upper surface of the locking portion 54, so that the stopper cover seals the container mouth and a closed state is maintained.

As shown in FIG. 5, when needing to pull out the stopper cover to open the container mouth portion 8, the pressing portion 51 of the button of the control member 5 is pressed inward, the locking portion 54 moves inward, the release portion 53 moves to a position of the second gap 47, and the limiting block loses its reliance; and under the elastic force action of the second elastic reset member 62, the linkage assembly moves downward, the base 44 also moves downward, and the squeezing of the sealing sleeve 3 is released, so that the sealing sleeve 3 restores to its initial state, the stopper cover is opened and can be pulled out from the container mouth, and the first elastic reset member 52 pushes the button to restore to its initial state.

Through holes are formed at the same bottom positions of the base 44 and the linkage body 43, and the two through holes are connected to form an exhaust hole. An exhaust rod 7 is further arranged, and the exhaust rod 7 includes a rod body 72 and a rod cap 73 with a radius larger than the radius of the rod body 72 and arranged at an upper end thereof, where an upper end of the rod cap 73 abuts against the fixing member 61, a lower end of the rod body 72 is arranged in the exhaust hole, a third elastic reset member 71 is sleeved outside the rod body 72, an upper end of the third elastic reset member 71 abuts against a lower end of the rod cap 73, and a lower end of the third elastic reset member 71 abuts against the bottom of the linkage body 43.

Reset springs are generally employed as the first elastic reset member 52, the second elastic reset member 62 and the third elastic reset member 71.

The foregoing descriptions are merely preferred embodiments of the present invention and are not intended to limit the scope of protection of the present invention. That is to say, all equivalent changes and modifications made based on the contents of the patentable scope of the present invention shall fall within the technical scope of the present invention.

The present invention mainly solves the problems in the prior art that an elastic sealing sleeve cannot expand in a directional manner, and the container stopper cannot be opened freely only by relying on elasticity of the elastic sealing sleeve.

We claim:

1. A threadless stopper cover for containers, comprising
an outer cover body (1),
an inner cover body (2), and
a sealing sleeve (3) sleeved on an outer wall of the inner cover body (2),
wherein the outer cover body (1) and the inner cover body (2) are fixedly connected, and a first gap (81) for accommodating a container mouth portion (8) is formed between the sealing sleeve (3) and the outer cover body (1);
the inner cover body (2) is provided with a driving assembly capable of moving up and down and squeezing the sealing sleeve (3) for radial expansion;
the inner cover body (2) comprises a cylinder body (21) and a first flange (22) protruding outward at the top of the cylinder body, wherein the first flange (22) is fixedly connected to an inner wall of the outer cover body (1), and the sealing sleeve (3) is sleeved on an outer wall of the cylinder body (21);
the driving assembly comprises
a driving plate (41),
a linkage assembly, and
a base (44), wherein the driving plate (41) is provided with one or more sliding rods (411), and one or more sliding rod holes (23) are formed on the first flange (22) for the corresponding one or more sliding rods (411) to pass through;

the linkage assembly comprises a linkage body (43) that is configured to be inserted into the cylindrical body (21) of the inner cover body (2) and a second flange (42) protruding outward at the top of the linkage body (43);

the driving plate (41) is arranged on a lower surface of the first flange (22), and each of the one or more sliding rods (411) penetrates through each of the corresponding one or more sliding rod holes (23) and is fixedly connected with the second flange (42);

the base (44) is arranged at the bottom of the linkage body (43), and the bottom of the sealing sleeve (3) is in contact with the base (44); and limiting members are arranged inside the linkage body (43), and the outer cover body (1) is provided with a control member (5) capable of locking or releasing the limiting members.

2. The threadless stopper cover for containers according to claim 1, wherein two limiting members are arranged inside the linkage body (43), each limiting member comprises two oppositely arranged limiting rods (45), protruding limiting blocks (46) are arranged at relative positions at upper ends of the two oppositely arranged limiting rods (45), and a second gap (47) is formed between the two limiting blocks (46); and two mounting holes (11) are symmetrically formed on an outer wall of the outer cover body (1), the control member (5) is arranged inside the two mounting holes (11), and the control member (5) comprises buttons and a first elastic reset member (52), wherein the buttons include a pressing portion (51), a release portion (53) extending toward the inside of the outer cover body (1) and having a width smaller than that of the second gap (47), and a locking portion (54) having a width larger than that of the second gap (47) that are fixedly connected from outside to inside.

3. The threadless stopper cover for containers according to claim 1, wherein a fixing member (61) is arranged inside the inner cover body (2), and a second elastic reset member (62) is arranged between the fixing member (61) and the bottom of the linkage body (43).

4. The threadless stopper cover for containers according to claim 3, wherein a clamping portion (441) is arranged on the base (44), an upward recessed portion is formed at the bottom of the linkage body (43), and a clamping interface (431) for receiving the clamping portion (441) is arranged on an inner wall of the recessed portion.

5. The threadless stopper cover for containers according to claim 4, wherein each of bottom position of the base (44) and the linkage body (43) is provided with a through hole, and the through holes at the bottom position of the base (44) and the linkage body (43) are connected to form an exhaust hole;

an exhaust rod (7) is further arranged, and the exhaust rod (7) includes a rod body (72) and a rod cap (73) with a radius larger than the radius of the rod body (72) and arranged at an upper end thereof, wherein an upper end of the rod cap (73) abuts against the fixing member (61), a lower end of the rod body (72) is arranged in the exhaust hole, a third elastic reset member (71) is sleeved outside the rod body (72), an upper end of the third elastic reset member (71) abuts against a lower end of the rod cap (73), and a lower end of the third elastic reset member (71) abuts against the bottom of the linkage body (43).

6. The threadless stopper cover for containers according to claim 1, wherein an inwardly protruding bottom flange (31) is arranged at the bottom of the sealing sleeve (3), and the bottom flange (31) is in contact with the base (44).

7. The threadless stopper cover for containers according to claim 1, wherein the driving plate (41) is provided with at least two sliding rods (411), and at least two sliding rod holes (23) consistent with the number of the at least two sliding rods (411) in quantity are formed on the first flange (22); and a plurality of hooks (412) are arranged at the top of the at least two sliding rods, (411) and each of the plurality of the hooks (412) corresponds to each of the at least two sliding rods (411), and the second flange (42) is provided with bayonets (421) corresponding to the at least two sliding rods (411) in quantity for fixing the plurality of the hooks (412).

* * * * *